US007398731B2

(12) United States Patent
Schönberger

(10) Patent No.: US 7,398,731 B2
(45) Date of Patent: Jul. 15, 2008

(54) PRESS CONTAINING AN OSCILLATING DOCTOR AND OSCILLATING ROLLER MOVED TOGETHER

(75) Inventor: Wolfgang Schönberger, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 267 days.

(21) Appl. No.: 11/197,244

(22) Filed: Aug. 4, 2005

(65) Prior Publication Data

US 2006/0027111 A1 Feb. 9, 2006

(30) Foreign Application Priority Data

Aug. 4, 2004 (DE) ..... 10 2004 037 765

(51) Int. Cl.
*B41F 31/00* (2006.01)

(52) U.S. Cl. ..... 101/350.3; 101/352.06; 101/DIG. 38

(58) Field of Classification Search ..... None
See application file for complete search history.

(56) References Cited

U.S. PATENT DOCUMENTS 3,750,228 A * 8/1973 Wake ..... 101/157
3,964,386 A * 6/1976 Dini ..... 101/170
4,244,292 A * 1/1981 Williams et al. ..... 101/350.3
4,428,291 A 1/1984 Dorow
4,753,166 A * 6/1988 Fischer ..... 101/350.3
5,062,362 A * 11/1991 Kemp ..... 101/DIG. 38
6,578,481 B1 6/2003 Beisel et al.
6,752,077 B2 * 6/2004 Kolbe et al. ..... 101/350.3

FOREIGN PATENT DOCUMENTS

DE 3117341 A1 6/1917
DE 2 321 377 4/1974
DE 4401238 A1 7/1995
DE 197 56 077 A1 6/1999

* cited by examiner

*Primary Examiner*—Jill E. Culler
(74) *Attorney, Agent, or Firm*—Laurence A. Greenberg; Werner H. Stemer; Ralph E. Locher

(57) ABSTRACT

A press contains an oscillating doctor and a motor for driving the oscillating doctor axially. The press further has at least one oscillating roller (ink distributor roller and/or damping solution distributor roller) and an oscillating mechanism, via which the oscillating roller is connected to the motor such that the oscillating roller and the oscillating doctor can be driven axially together by the motor.

15 Claims, 5 Drawing Sheets

PRESS CONTAINING AN OSCILLATING DOCTOR AND OSCILLATING ROLLER MOVED TOGETHER

BACKGROUND OF THE INVENTION

Field of the Invention

The present invention relates to a press having an oscillating doctor and a motor for driving the oscillating doctor axially.

In published, non-prosecuted German patent application DE 31 17 341 A1 (corresponding to U.S. Pat. No. 4,428,291), such a press is described and it is emphasized that an engraved roller of the press, corresponding to the prior art, would make it unnecessary to roll out the tacky printing ink to form a thin film, which would permit a simple and space-saving inking unit construction.

The drawback here is that the excessive simplification of the inking unit and printing unit construction is made at the cost of printing quality.

SUMMARY OF THE INVENTION

It is accordingly an object of the invention to provide a press that overcomes the above-mentioned disadvantages of the prior art devices of this general type, in which there is an acceptable compromise between the simplification of the printing unit construction and printing quality.

With the foregoing and other objects in view there is provided, in accordance with the invention, a press. The press contains an oscillating doctor, a motor for driving the oscillating doctor axially, at least one oscillating roller, and an oscillating mechanism connecting the oscillating roller to the motor such that the oscillating roller and the oscillating doctor are driven axially together by the motor.

The press according to the invention has an oscillating doctor and a motor for driving the oscillating doctor axially. The press further has at least one oscillating roller and an oscillating mechanism, via which the oscillating roller is connected to the motor in such a way that the oscillating roller and the oscillating doctor can be driven axially together by the motor.

In the press according to the invention, by the oscillating roller, it is possible not only to roll out the printing ink or the damping solution but even to distribute it over the printing width, so that a high printing quality is ensured.

Since no separate motor is required to drive the axial back and forth movement of the oscillating roller and, instead, the motor which is present in any case and which drives the axial back and forth movement of the oscillating doctor is also used to drive the axial back and forth movement of the oscillating roller, the printing unit construction is not disproportionately complicated by the integration of the oscillating roller.

In one development, the press contains an anilox inking unit, to which the oscillating doctor belongs.

In one further development, the press contains an offset printing unit, to which the anilox inking unit belongs.

In a further development, the anilox inking unit contains an engraved roller having an engraved roller gear and an ink applicator roller having an ink applicator roller gear. The engraved roller gear and the ink applicator roller gear are braced against each other under the action of a load torque in order to secure their tooth flank contact. The oscillating doctor and the oscillating roller are disposed mechanically in such a way that the oscillating doctor and the oscillating roller contribute to the production of the load torque.

In a further development, the oscillating mechanism is assigned a spring in order to keep the load torque constant.

In a further development, the spring is disposed mechanically in such a way that the spring is always stressed to the maximum when the oscillating doctor or the oscillating roller is in a dead position in the course of its back and forth movement.

In a further development, the spring is assigned a cam in order to stress the spring periodically.

In a further development, the engraved roller and the ink applicator roller are in rolling contact with each other without any bearer ring.

In a further development, the oscillating doctor bears on the engraved roller.

In a further development, the oscillating mechanism is configured in such a way that the oscillating doctor and the oscillating roller oscillate axially with oscillation amplitudes that are different from each other.

In a further development, the oscillating mechanism is configured in such a way that the oscillating doctor and the oscillating roller oscillate with an oscillation phase offset in relation to each other.

In a further development, the oscillating doctor and the oscillating roller are connected mechanically in parallel with each other via the oscillating mechanism.

In a further development, the oscillating doctor and the oscillating roller are connected mechanically in series with each other via the oscillating mechanism.

In a further development, the oscillating roller is an ink distributor roller.

In a further development, the oscillating roller is a damping solution distributor roll.

Other features which are considered as characteristic for the invention are set forth in the appended claims.

Although the invention is illustrated and described herein as embodied in a press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
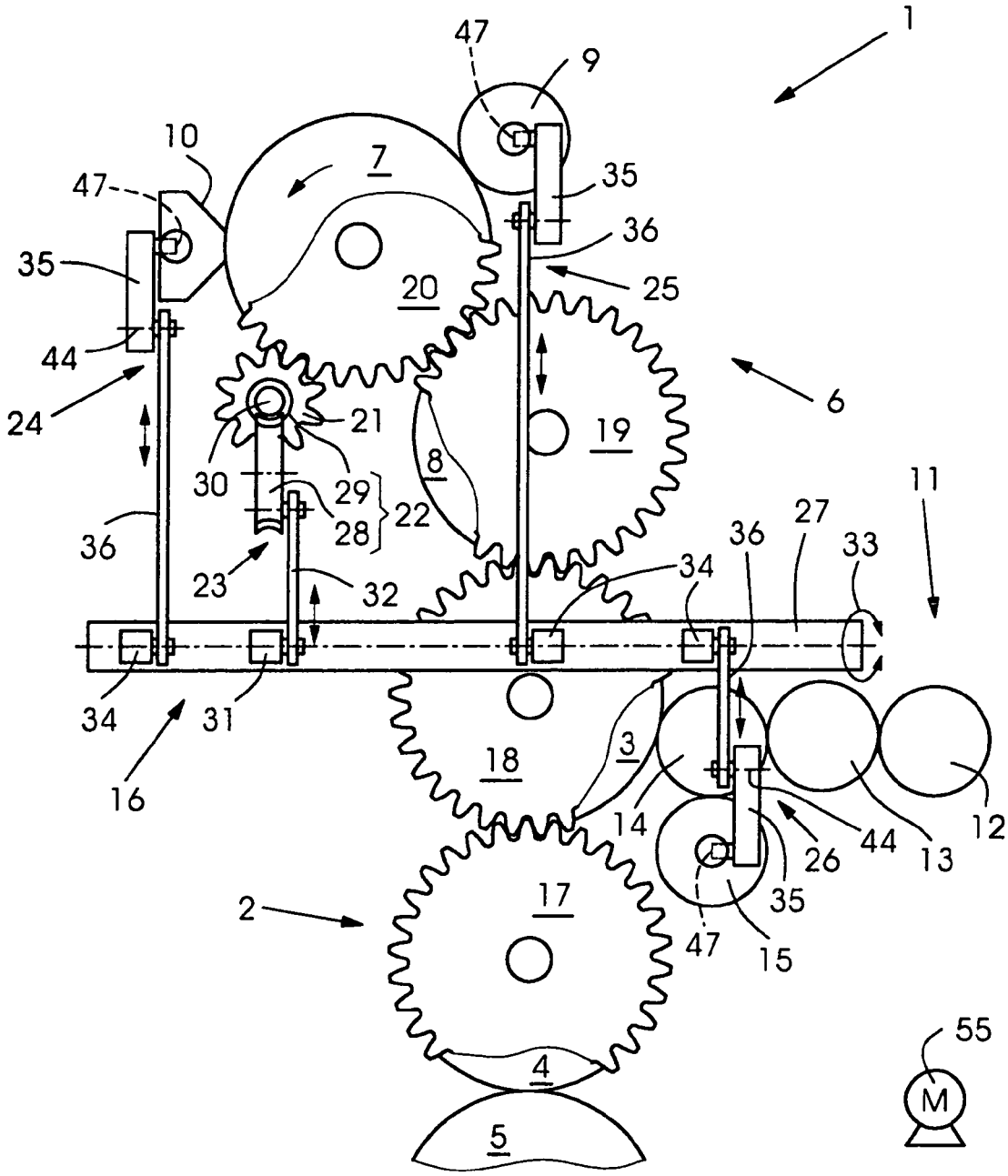
FIG. 1 is a diagrammatic illustration of a first exemplary embodiment, in which an oscillating doctor, an ink distributor roller and a damping solution distributor roller are connected mechanically in parallel with one other via an oscillating shaft of the oscillating mechanism according to the invention.

In all the figures of the drawing, sub-features and integral parts that correspond to one another bear the same reference symbol in each case. Referring now to the figures of the drawing in detail and first, particularly, to FIGS. 1-3 thereof, there is shown a press 1 having an offset printing unit 2, which contains a printing form cylinder 3, a blanket cylinder 4 and an impression cylinder 5. The offset printing unit 2 further contains an anilox inking unit 6 having an engraved roller 7 and an ink applicator roller 8, and also a dampening unit 11 having a dip roller 12, a metering roller 13, a damping solution applicator roller 14 and a damping solution distributor roller 15 as an oscillating roller. The anilox inking unit 6 contains an oscillating doctor 10, which bears on the engraved roller 7 and feeds the highly viscous printing ink to the latter. The oscillating doctor 10 is a metering doctor different from a cleaning doctor and is, for example, a chamber-type doctor. The axial back and forth movement of the oscillating doctor 10 is driven via an oscillating mechanism 16, whose construction, which is partly different from exemplary embodiment to exemplary embodiment, will be explained in detail in the following text.

Figure 5:
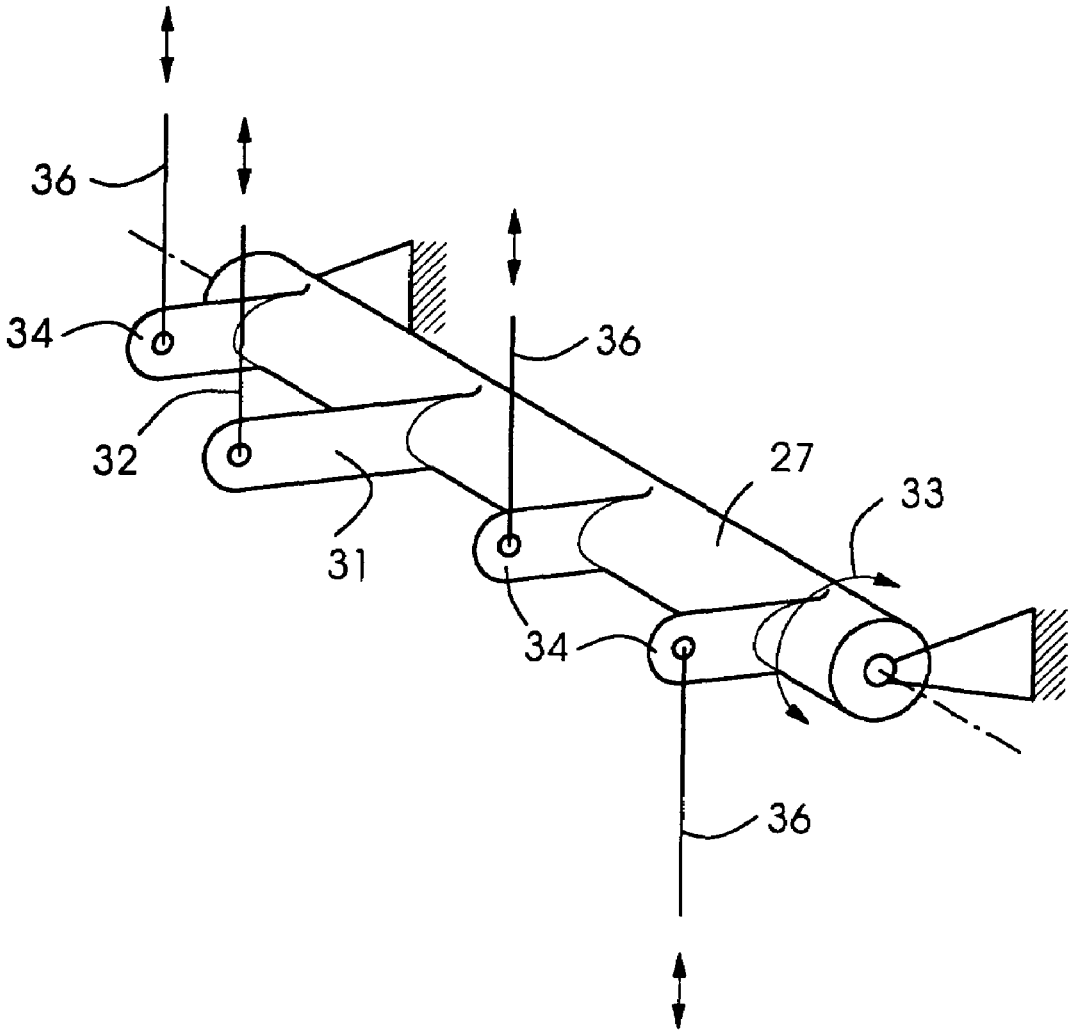
FIG. 5 is a diagrammatic, perspective view of the oscillating shaft of the first exemplary embodiment in a three-dimensional illustration.

FIGS. 1 and 5 show a first exemplary embodiment, in which an ink distributor roller 9 bears on the engraved roller 7 as an oscillating roller. The two oscillating rollers, that is the ink distributor roller 9 and the damping solution distributor roller 15, and the oscillating doctor 10 are connected to one another via the oscillating mechanism 16 in such a way that these three aforementioned oscillating elements can be driven axially together by one and the same motor, a main motor 55 of the press 1, illustrated only schematically in the drawing. The drive output from the main motor 55 is transmitted from a blanket cylinder gear 17 via a printing form cylinder gear 18, an ink applicator roller gear 19, an engraved roller gear 20, a drive gear 21 belonging to the oscillating mechanism 16, a worm gear mechanism 22 and a first coupler mechanism 23 to an oscillating shaft 27, in the above-mentioned order.

The drive gear 21 meshes with the engraved roller gear 20 and the printing form cylinder gear 18 meshes with the ink applicator roller gear 19, so that the engraved roller gear 20 and the ink applicator roller gear 19 are braced against each other under the drive torque exerted on the ink applicator roller gear 19 by the printing form cylinder gear 18 and the opposing load torque of the oscillating mechanism 16, which load torque is exerted by the oscillating mechanism 16 on the engraved roller gear 20 via the drive gear 21. This bracing secures the tooth flank contact, important for the printing quality, between the engraved roller gear 20 and the ink applicator roller gear 19 and would not be provided to a sufficient extent if the oscillating mechanism 16 were driven directly from the printing form cylinder 3 and not via the anilox inking unit 6 or its rollers, that is to say if the drive gear 21 were to mesh with the printing form cylinder gear 18.

In the last-named, hypothetical case, the two oscillating rollers and the oscillating doctor 10 would contribute nothing to the torque, so that the latter would have to be produced by the engraved roller 7 on its own and, accordingly, the bracing of the toothing systems would be too small. By contrast, in the first exemplary embodiment shown, the toothing system bracing is even so high that rolling contact without bearer rings is made possible between the engraved roller 7 and the ink applicator roller 8. The engraved roller 7 and the ink applicator roller 8 do not need to be equipped with supporting rings running on one another, which in principle act like bearer rings, in order to ensure the printing quality, which not only results in that the production costs are reduced but also the roller adjustment is simplified.

The worm gear mechanism 22 contains a worm gear 28 and a worm 29, which is fixed to the drive gear 21 so as to rotate with it via a connecting shaft 30. A first coupler mechanism 23 contains a circulating drive crank, a rocker moving to and fro as an output drive and a crank rod 32 connecting the drive crank in an articulated manner to the rocker, and thus corresponds to the "oscillating rocker" mechanism type. The drive crank is formed by the worm gear 28 and the rocker by a long lever arm 31 belonging to the oscillating shaft 27. The oscillating shaft 27 executes a rotary swinging motion 33 with a change of direction, during which the long lever arm oscillates back and forth, and transmits the drive output via a second coupler mechanism 24 to the oscillating doctor 10, via a third coupler mechanism 25 to the ink distributor roller 9 and via a fourth coupler mechanism 26 to the damping solution distributor roller 14. The second 24, third 25 and fourth 26 coupler mechanisms each contain as a swinging drive arm a short lever arm 34 belonging to the oscillating shaft 27, a rocker 35 as output dive and a coupler 36 in order to connect the short lever arm 34 in an articulated manner to the rocker 35, and thus corresponds to the "double rocker" mechanism type.

FIG. 1 shows that the oscillating doctor 10, the ink distributor roller 9 and the damping solution distributor roller 14 are connected mechanically in parallel with one another via the oscillating mechanism 16, more precisely via its second 24, third 25 and fourth 26 coupler mechanisms. By corresponding dimensioning of the mechanism elements of the oscillating mechanism 16, the latter is configured in such a way that it swings the oscillating doctor 10 axially with a different, preferably smaller, amplitude than the oscillating rollers (ink distributor roller 9, damping solution distributor roller 14). For example, the amplitude of the oscillating doctor 10 can be about 1 millimeter and the amplitude of the distributor and oscillating rollers 9, 14 can be about 5 millimeters, therefore a multiple.

Figure 2:
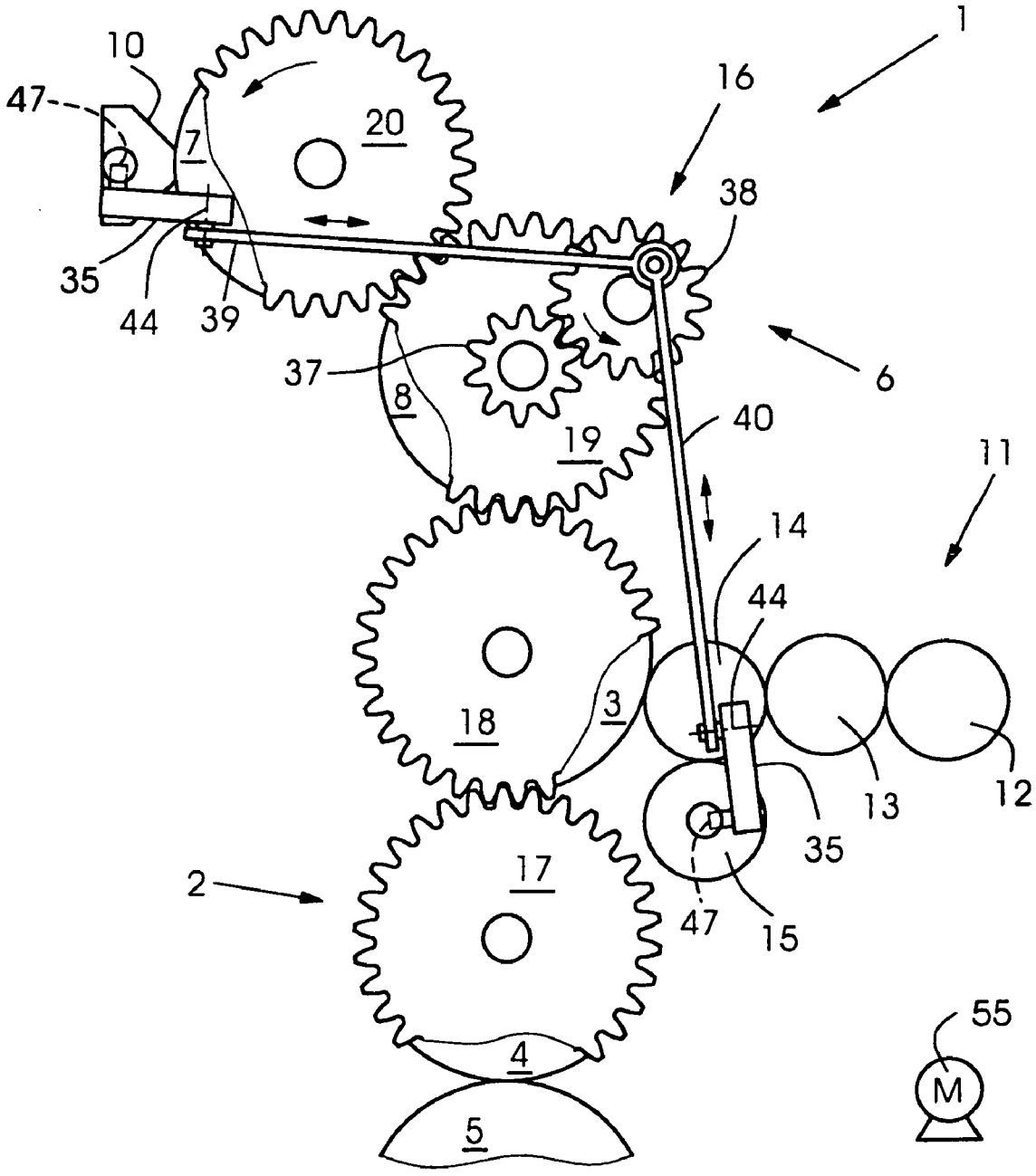
FIG. 2 is a diagrammatic illustration of a second exemplary embodiment, in which the oscillating doctor and the damping solution distributor roller are connected mechanically in parallel with each other via a crank belonging to the oscillating mechanism.

FIG. 2 shows a second exemplary embodiment that does not differ from the first with respect to the gears 17 to 20. In the second exemplary embodiment, the oscillating mechanism 16 contains a pinion 37, which is connected to the ink applicator roller gear 19 so as to rotate with it and meshes with a gear which forms a common crank 38 for a first crank rod 39 and a second crank rod 40. The first crank rod 39 is connected to the oscillating doctor 10 via one rocker 35, and the second crank rod 40 is connected via the other rocker 35 to the damping solution distributor roller 15, which is the only oscillating roller in the second exemplary embodiment.

The two oscillating elements, that is the distributor or oscillating roller 15 and the oscillating doctor 10, are therefore connected mechanically in parallel with each other via the oscillating mechanism 16 or its two coupler mechanisms of the "oscillating rocker" mechanism type, so that these oscillating elements can be driven axially together by the aforesaid main motor 55. By corresponding dimensioning of the mechanism elements of the oscillating mechanism 16, the latter is configured in such a way that, between the axial oscillation of the oscillating doctor 10 and the axial oscillation of the distributor or oscillating roller 15, a phase shift is provided, such that oscillating movements of these two oscillating elements which are opposite to each other, at least from time to time, are established. Furthermore, the dimensioning ensures that in each case, for each two revolutions of the printing form cylinder 3, both the oscillating doctor 10 and the distributor or oscillating roller 15 execute a complete axial oscillation; the oscillating movements thus have a half-turn nature.

Figure 3:
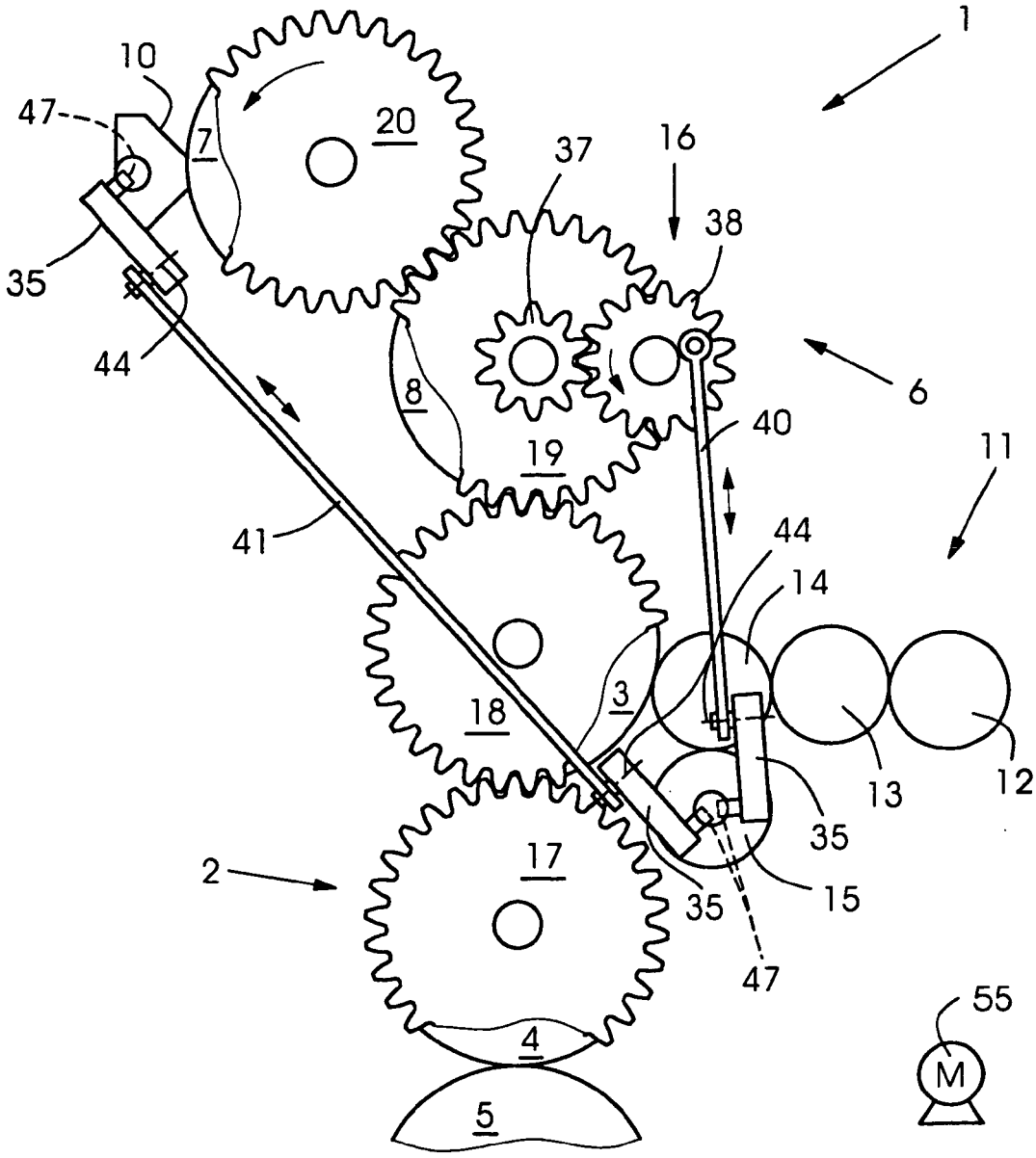
FIG. 3 is a diagrammatic illustration of a third exemplary embodiment, in which the oscillating doctor and the damping solution distributor roller are connected mechanically in series by couplers belonging to the oscillating mechanism.

FIG. 3 shows a third exemplary embodiment which does not differ from the second exemplary embodiment with respect to the section of the mechanism transmitting the drive output from the pinion 37 to the oscillating roller (damping solution distributor roller 15). In the third exemplary embodiment, provision is likewise made for the common motor or main motor 55 to drive the two oscillating elements (oscillating doctor 10, distributor or oscillating roller 15) axially together.

The special feature of the third exemplary embodiment is that the two oscillating elements are connected mechanically in series with each other via the oscillating mechanism 16, so that the drive output is transmitted first via the coupler mechanism containing the crank rod 40 to the one oscillating element, here the distributor or oscillating roller 15, and then passed on from this oscillating element via a further coupler mechanism to the other oscillating element, here the oscillating doctor 10. The further coupler mechanism corresponds to the "double rocker" mechanism type and contains a coupler 4 which is connected mechanically to the oscillating elements via a rocker 35.

According to a modification of the third exemplary embodiment, not illustrated in the drawing, the coupler 41 and the rockers 35 are replaced by a single rocker in order to form the section of the mechanism connecting the two oscillating elements.

Figure 4:
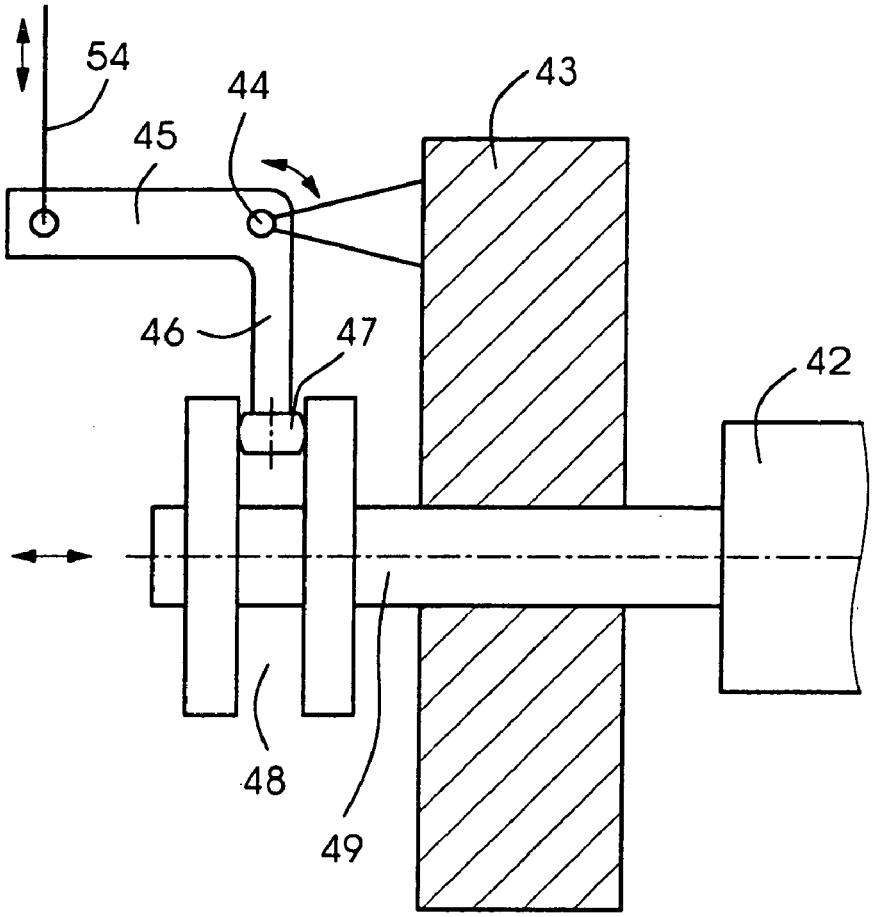
FIGS. 4 and 6 are diagrammatic illustrations of common details of the exemplary embodiments illustrated in FIGS. 1 to 3.

FIG. 4 shows that an oscillating element 42 is mounted in a side frame 43 such that it can be displaced axially. This oscillating element 42 can be the ink distributor roller 9 of the first exemplary embodiment or the damping solution distributor roller 15 or the oscillating doctor 10 of the first to third exemplary embodiment. It becomes clear that the rocker 35 contains an axis of rotation 44, a first lever arm 45 and a second lever arm 46. A mechanism element 54 is attached to the first lever arm 45 and the second lever arm 46 has a driver roller 47, by which the second lever arm 46 engages in an annular groove 48, which has an axle journal 49 of the oscillating element 42.

If, for example, the oscillating element 42 is the oscillating doctor 10 of the second exemplary embodiment (see FIG. 2), then the mechanism element 54 is the first crank rod 39.

Figure 6:
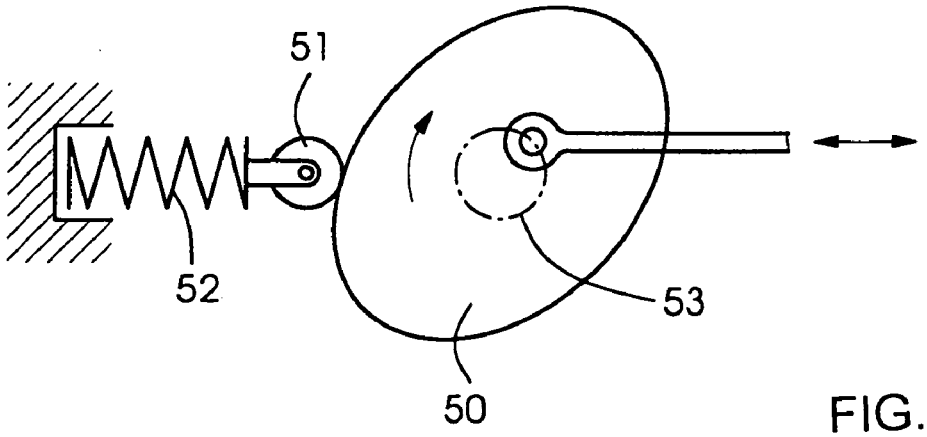

FIG. 6 shows a cam mechanism integrated in the oscillating mechanism 16 and having a cam 50 and a cam roller 51 which is pressed against the cam 50 by a spring 52. The cam 50 is connected to a crank 53 so as to rotate with it, which can be the worm gear 28 of the first exemplary embodiment or the crank 38 of the second and third exemplary embodiment. The spring 52 is periodically stressed by the cam 50 rotating together with the crank 53 in such a way that the spring 52 reaches its maximum stress in each case at a time at which at least one of the oscillating elements is located at the point of reversal or the dead position of its oscillating movement.

The oscillating element, which is axially stationary at this time, contributes nothing to the production of the aforesaid load torque which secures the tooth flank bracing present between the engraved roller gear 20 and the ink applicator roller gear 19.

The cam contour of the cam 50 is such that the failure of the load torque induced by the dead position is compensated for by the stress of the spring 52 and the load torque is kept continuously constant.

This application claims the priority, under 35 U.S.C. § 119, of German patent application No. 10 2004 037 765.0, filed Aug. 4, 2004; the entire disclosure of the prior application is herewith incorporated by reference.

I claim:

1. A press, comprising:

an oscillating doctor;

a motor for driving said oscillating doctor axially;

at least one oscillating roller; and an oscillating mechanism connecting said oscillating roller to said motor such that said oscillating roller and said oscillating doctor are driven axially together by said motor, said oscillating doctor and said oscillating roller being connected mechanically in parallel with each other via said oscillating mechanism.

2. The press according to claim 1, wherein said oscillating mechanism is configured such that said oscillating doctor and said oscillating roller oscillate axially with oscillation amplitudes that are different from each other.

3. The press according to claim 1, wherein said oscillating mechanism is configured such that said oscillating doctor and said oscillating roller oscillate with an oscillation phase offset in relation to each other.

4. The press according to claim 1, wherein said oscillating roller is an ink distributor roller.

5. The press according to claim 1, wherein said oscillating roller is a damping solution distributor roller.

6. A press, comprising:

an oscillating doctor;

a motor for driving said oscillating doctor axially;

at least one oscillating roller; and an oscillating mechanism connecting said oscillating roller to said motor such that said oscillating roller and said oscillating doctor are driven axially together by said motor, said oscillating doctor and said oscillating roller being connected mechanically in series with each other via said oscillating mechanism.

7. The press according to claim 6, wherein said oscillating mechanism is configured such that said oscillating doctor and said oscillating roller oscillate axially with oscillation amplitudes that are different from each other.

8. The press according to claim 6, wherein said oscillating mechanism is configured such that said oscillating doctor and said oscillating roller oscillate with an oscillation phase offset in relation to each other.

9. The press according to claim 6, wherein said oscillating roller is an ink distributor roller.

10. The press according to claim 6, wherein said oscillating roller is a damping solution distributor roller.

11. A press, comprising:

an anilox inking unit;

an oscillating doctor contained in said anilox inking unit;

a motor for driving said oscillating doctor axially;

at least one oscillating roller;

an oscillating mechanism connecting said oscillating roller to said motor such that said oscillating roller and said oscillating doctor are driven axially together by said motor; and an offset printing unit containing said anilox inking unit;

said anilox inking unit containing:

an engraved roller having an engraved roller gear; and an ink applicator roller having an ink applicator roller gear, said engraved roller gear and said ink applicator roller gear being braced against each other under an action of a load torque for securing their tooth flank contact, and said oscillating doctor and said oscillating roller being disposed mechanically such that said oscillating doctor and said oscillating roller contribute to producing the load torque.

12. The press according to claim 11, wherein said oscillating mechanism has a spring for keeping the load torque constant.

13. The press according to claim 12, wherein said spring is disposed mechanically such that said spring is always stressed to a maximum when 8aid oscillating doctor or said oscillating roller is in a dead position in a course of its back and forth movement.

14. The press according to claim 13, wherein said oscillating mechanism has a cam for stressing said spring periodically.

15. The press according to claim 11, wherein said engraved roller and said ink applicator roller are in rolling contact with each other without any bearer ring.

* * * * *